US005165261A

United States Patent [19]

Cho

[11] Patent Number: 5,165,261

[45] Date of Patent: Nov. 24, 1992

[54] JET APPLICATOR FOR MULTI-COLOR FOAM DYEING MACHINE

[75] Inventor: Bak-Hyun Cho, Seoul, Rep. of Korea

[73] Assignee: Dong Yang Textile Ind. Co., Ltd., Kyunggi, Rep. of Korea

[21] Appl. No.: 662,833

[22] Filed: Mar. 1, 1991

[30] Foreign Application Priority Data

Mar. 5, 1990 [KR] Rep. of Korea ..... 2523/1990

[51] Int. Cl.[5] ..... D06B 1/06

[52] U.S. Cl. ..... 68/205 R; 118/419; 68/900

[58] Field of Search ..... 68/205 R, 204, 200, 68/900; 8/151; 118/419

[56] References Cited

U.S. PATENT DOCUMENTS

| | | | |
|---|---|---|---|
| 3,937,044 | 2/1976 | Balmforth | 68/205 R |
| 4,403,360 | 9/1983 | Finney et al. | 68/205 R X |
| 4,445,243 | 5/1984 | Bohrn et al. | 68/205 R X |
| 4,463,467 | 8/1984 | Gruber et al. | 68/205 R Y |

FOREIGN PATENT DOCUMENTS

| | | | |
|---|---|---|---|
| 3010038 | 9/1981 | Fed. Rep. of Germany | 68/205 R |
| 3108963 | 10/1982 | Fed. Rep. of Germany | 68/205 R |

OTHER PUBLICATIONS

E.P. 57, 830 Aug. 1982.

*Primary Examiner*—Frankie L. Stinson
*Attorney, Agent, or Firm*—Foley & Lardner

[57] ABSTRACT

A jet applicator for a multi-color type foam dyeing machine is disclosed. The applicator provides multi-color foams with a constant gap and uniform state between the color foam dyes for dyeing woven stuff. For forming the foam dyes in a wavy pattern, the applicator comprises foam discharging tubes inserted in holes formed on a lower portion of a rectangular type frame member, an inclined plate and a cylindrical roll provided beneath the frame member, and guide blades fixedly disposed to a movable traversing rod. Therefore, the woven stuff supplied at a constant rate can be dyed over a wide range of various colorful patterns and designs.

4 Claims, 4 Drawing Sheets

FIG. 3
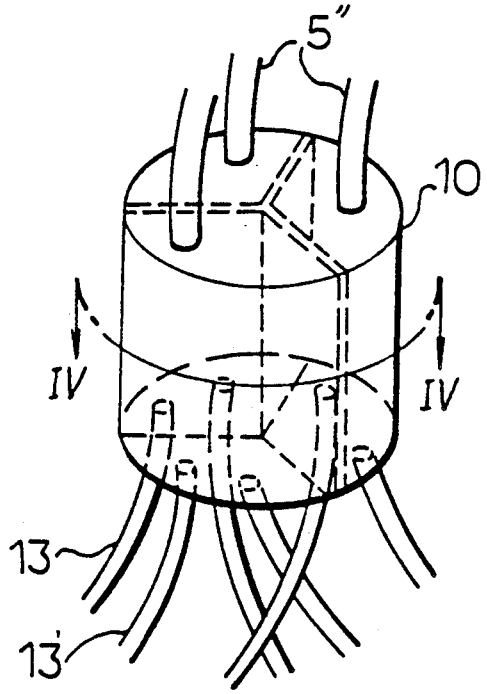
FIG. 4
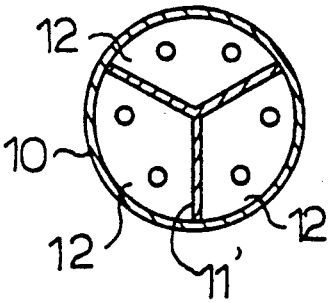
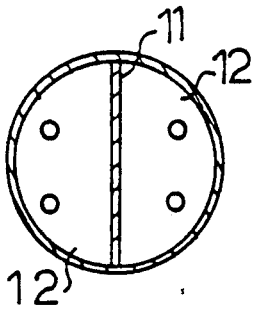
FIG. 5A
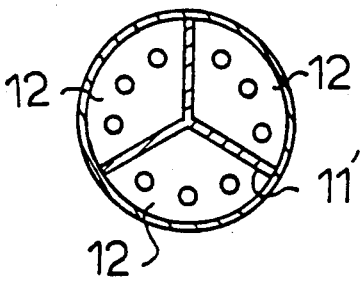
FIG. 5B
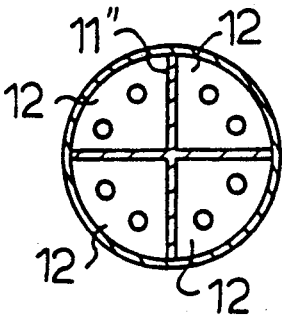
FIG. 5C

JET APPLICATOR FOR MULTI-COLOR FOAM DYEING MACHINE

BACKGROUND OF THE INVENTION

1. Field of the Invention

The present invention relates to a jet applicator for a dyeing machine, and more particularly relates to a jet applicator adapted for mounting and use on a multi-color type foam dyeing machine for distribution and application of foam color dyes in various patterns on woven stuff, fabrics and like textiles.

2. Summary of the Invention

The present invention provides a novel jet applicator for applying and distributing color dyes, particularly foam color dyes, on woven stuff, fabrics and like textile materials in desired designs and pattern in a safe and efficient manner.

Accordingly, an object of the present invention is to provide a jet applicator for dispensing, distributing and applying color dyes on woven stuff, fabrics and like textile materials.

A further object of the present invention is to provide a jet applicator that is adapted for mounting and operation on a multi-color type foam dyeing machine for use in distributing and applying color foam dyes in various designs and patterns on woven stuffs, fabrics and like textile materials.

Additional objects and advantages of the present invention will be set forth, in part, in the description which follows and, in part, will be obvious from the description, or may be learned by practice of the invention. The objects and advantages of the invention will be realized and attained by means of the elements and combinations particularly pointed out in the appended claims.

To achieve the objects and in accordance with the purpose of the invention, as embodied and described herein, the jet applicator of the present invention comprises a frame member, a plurality of foam distributors disposed on the frame member, each foam distributor having at least two foam reservoir chambers, a plurality of foam supplying tubes connecting each foam reservoir chamber to a foam generator, a plurality of foam discharging tubes each having a foam supply end connected to a foam chamber and a foam discharge end secured to the frame member, an inclined plate removably provided beneath the foam discharge ends of the foam discharging tubes, a roller rotatably mounted adjacent to a lower portion of the inclined plate, a traversing rod movably provided above the inclined plate for reciprocal action along its axis, and a plurality of foam guide blades provided in an equally spaced relationship on the traversing rod.

The accompanying drawings, which are incorporated in and constitute a part of this specification, illustrate preferred embodiments of the present invention and, together with the description, serve to explain the principles of the present invention.

BRIEF DESCRIPTION OF THE DRAWINGS

FIG. 3 is a schematic, perspective view of a foam distributor used in the jet applicator of the present invention;

FIG. 4 is a cross-sectional view of the foam distributor having three chambers shown in FIG. 3, taken along line IV—IV;

FIG. 5A is a cross-sectional view, similar to the view shown in FIG. 4, of an alternate embodiment of the foam distributor shown in FIG. 3, having two chambers;

FIG. 5B is a cross-sectional view, similar to the view shown in FIG. 4, of an alternate embodiment of the foam distributor shown in FIG. 3, having three chambers;

FIG. 5C is a cross-sectional view, similar to the view shown in FIG. 4, of an alternate embodiment of the foam distributor shown in FIG. 3, having four chambers.

DETAILED DESCRIPTION OF THE PREFERRED EMBODIMENTS

Reference will now be made, in detail, to preferred embodiments of the present invention, examples of which are illustrated in the accompanying drawings. Whenever possible, the same reference numbers will be used throughout the drawings to refer to the same or like parts.

As set forth, the jet applicator of the present invention comprises a plurality of foam distributors, each having a plurality of reservoir chambers, provided on a rectangular type frame member and connected by a connecting member to one side of a movable plate reciprocated by a screw member so as to be moved with the movable plate, and a plurality of foam distributors having a plurality of foam discharging tubes fixedly disposed on the frame member while a foam guide inclined plate provided with a cylindrical roll is installed beneath the foam discharging tubes.

According to an embodiment of the present invention, a jet applicator for a multi-color type foam dyeing machine is provided, wherein the jet applicator comprises a plurality of foam distributors having a plurality of reservoir chambers and disposed on the upper portion of a rectangular type frame member reciprocated by a screw member, a plurality of foam discharging tubes connected to the bottom of each foam distributor and each end portion of the foam discharging tubes inserted into holes formed on the lower portion of the frame member, an inclined plate provided immediately beneath each end portion of the foam discharging tubes, a cylindrical roll mounted selectively, holdingly and rotatably to the lower portion of the inclined plate, a traversing rod provided above the inclined plate for reciprocal movement along its longitudinal axis when actuated by an air cylinder unit, and a plurality of guide blades secured in an equally spaced relationship to the traversing rod.

Figure 1:
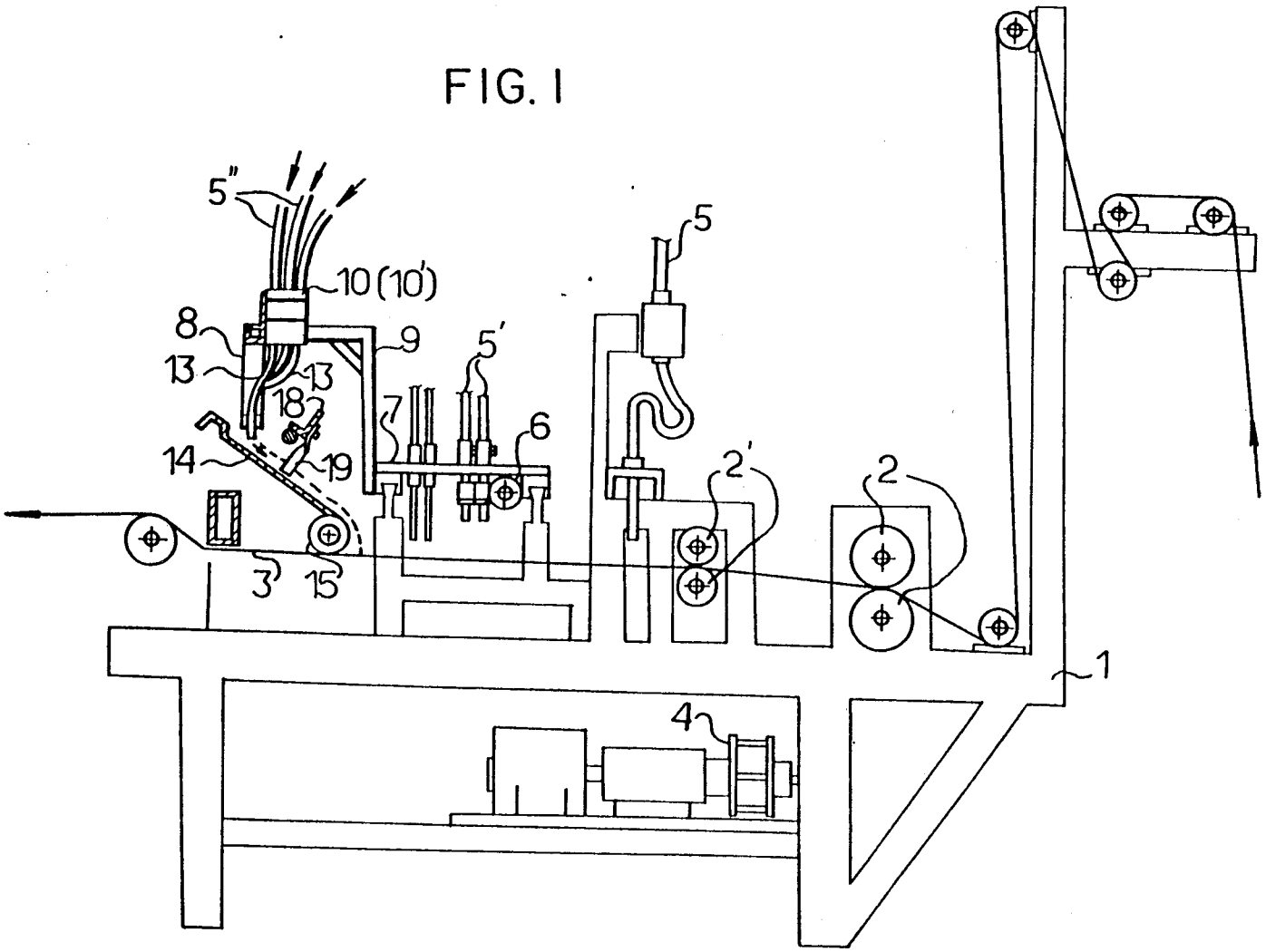
FIG. 1 is a schematic, elevational view of a multi-color type foam dyeing machine on which the jet applicator of the present invention may be used.
Figure 2:
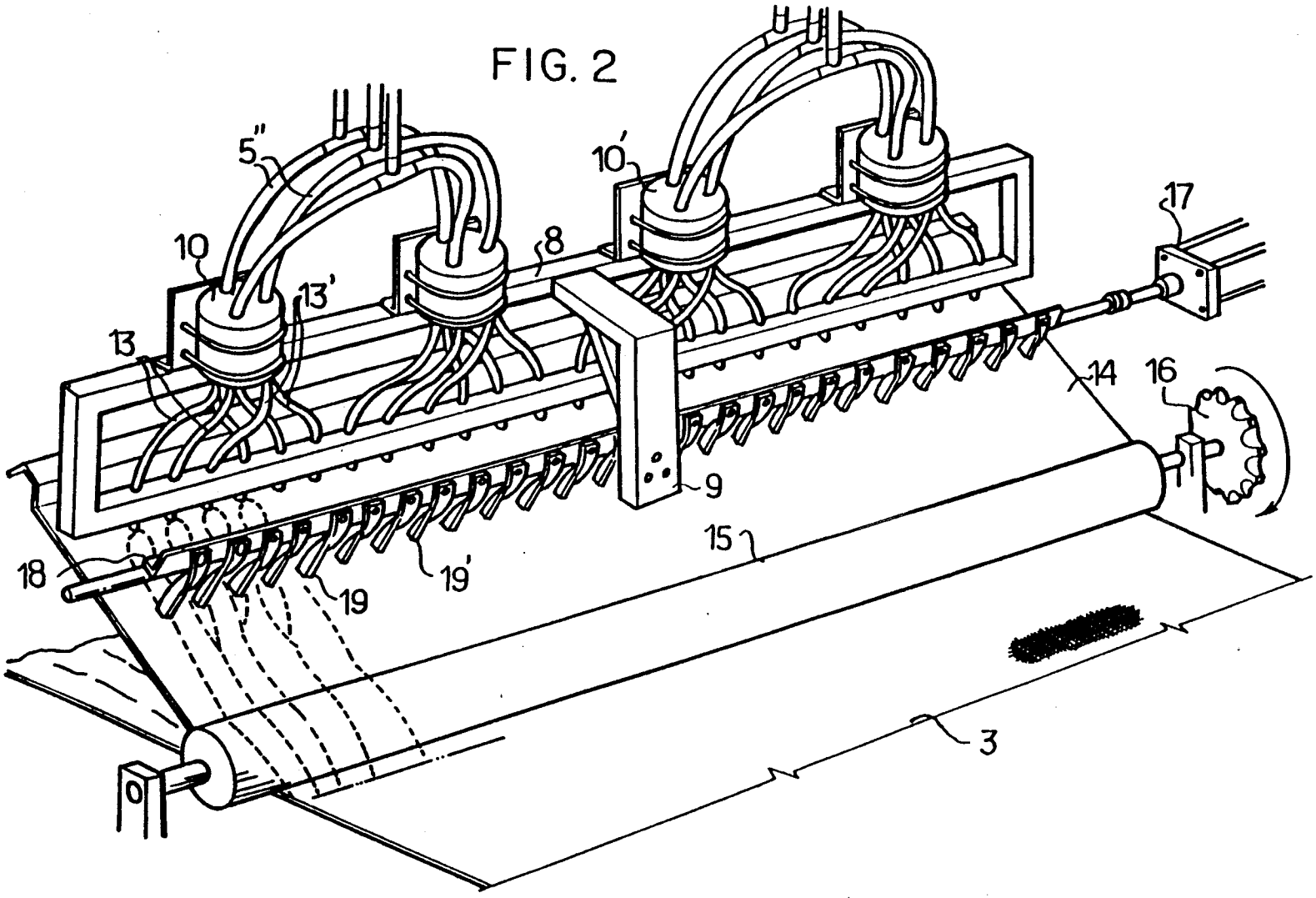
FIG. 2 is a perspective view of an embodiment of the jet applicator of the present invention.

Referring to FIGS. 1 and 2, an embodiment of the present invention will now be described.

A plurality of rollers 2 and 2' are rotatably mounted on a base support 1 in such a manner that woven stuff 3 can be fed and guided through the rollers 2 and 2'. Foam dyes of different colors generated from a foam generator 4 are respectively supplied through a plurality of foam supply tubes 5, 5', and 5''. A rectangular type frame member 8 is connected by a connecting member 9 to one side of a movable plate 7 that is operatively associated with a screw member 6 for reciprocal movement parallel with the plane of the rectangular frame member.

A plurality of foam distributors 10 and 10' are fixedly disposed on the upper portion of the frame member 8, and the inside construction or configuration of each foam distributor 10 is partitioned into two, three, or four districts or chambers by partitions 11, 11' and ''' as shown in FIGS. 5A–5C so as to form a plurality of reservoir chambers 12 for accumulating different color foams. A plurality of foam supply tubes 5'' connected to a foam generator 4 are connected to the top portion of each foam distributor 10 and communicate with each reservoir chamber, and a plurality of foam is charging tubes 13 and 13', originating from the bottom portions of each foam distributor 10 and communicating with each reservoir chamber, have each of their ends inserted into holes formed in an equally spaced relationship on the lower portion of the rectangular type frame member 8.

An inclined plate 14 is provided immediately beneath the foam discharging tubes 13 and 13' and also a cylindrical roll 15 is selectively, holdingly and rotatably mounted adjacent to the lower portion of the inclined plate 14 so that the cylindrical roll 5 is rotated by a sprocket wheel 16 fixed on one side of the cylindrical roll 15.

A traversing rod 18 is movably mounted above the inclined plate 14 for reciprocal action along its axis so as to be moved in the right and left directions by an air cylinder unit 17, and a plurality of guide blades 19 and 19' are secured in an equally spaced relationship corresponding to the foam discharging tubes 13 and 13'.

Figure 6:
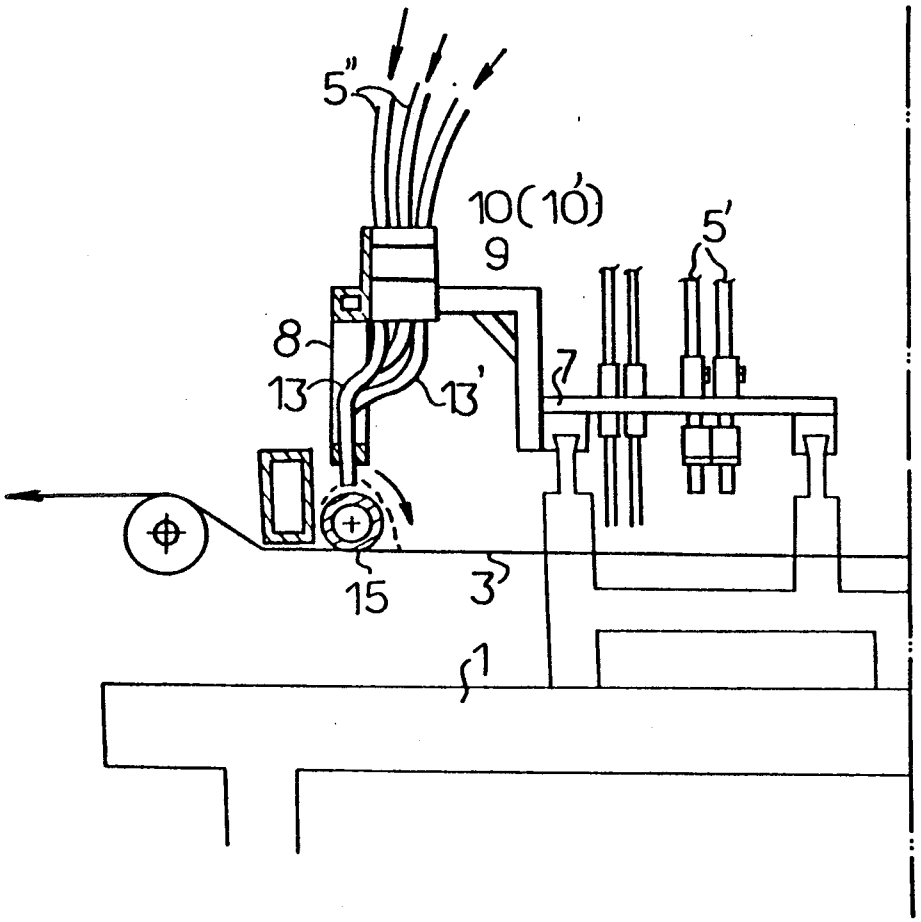
FIG. 6 is a schematic, elevational view showing a roller rotatably mounted adjacent to the foam discharging tubes according to another embodiment of the present invention.

In an alternate construction or embodiment as shown in FIG. 6, the cylindrical roll 15 is mounted immediately beneath the foam discharging tubes 13 and 13' without the inclined plate 15.

During operation, as the woven stuff or textile sheet 3 is fed in tensioned state at a predetermined speed or rate by the roll units 2 and 2', different color dye solutions containing foaming agents and air are supplied to their own assigned, respective foam generators 4 by a separate device (not shown) so as to produce foam dyes. The foam dyes are transported to and accumulated in the reservoir chambers 12 of the foam distributors 10 and 10' through the foam supplying tubes 5'', and then the foam dyes are discharged through the foam discharging tubes 13 and 13'. The discharged foam dyes flow along the inclined plate 14, run over the cylindrical roll 15 and then come in contact with the woven stuff 3 so as to dye the woven stuff 3.

As described above, the foam distributors 10 and 10' are formed with a plurality of reservoir chambers 12, and thus the characteristic of the above construction simplifies what would otherwise be a complicated construction or configuration in which each color foam dye has an independent reservoir chamber, respectively.

Moreover, each of the foam discharging tubes 13 and 13' is designed so as to be interchangeably inserted into the holes formed in the lower portion of the rectangular type frame member 8, and accordingly, it is another characteristic that the color arrangement and configuration can be easily changed according to the desired design or pattern.

Since the rectangular type frame member 8 is reciprocated side-to-side to form the discharged foam dyes in a wave pattern while the inclined plate 14 provides the discharged foams with a flow period, the flowing foam dyes flow in an orderly and even manner in contact with adjacent foams having different colors, while at the same time the flowing state of the foam dyes can be confirmed by simple visual inspection. Thus, as a further characteristic and advantage of the present invention, foam dye distribution can be easily and uniformly adjusted.

The cylindrical roll 15 maintains a stop state or a rotating state, and especially when the cylindrical roll 15 is rotating, the foam dyes are rapidly distributed and transferred onto the woven stuff 3 so as to permeate into it.

In addition, the traversing rod 18 having foam guide blades 19 and 19' secured in equally spaced relationship or configuration is operatively associated with an air cylinder unit 17 for reciprocal movement along the central axis of the traversing rod, and consequently, the flowing foam dyes are guided by the guide blades in a wavy or zig-zag formation, or is guided to mix adjacent foams, so that the woven stuff may be dyed in the desired designs or patterns.

Thus, as an aspect of the present invention, the foam dye discharged from each of the foam discharging tubes flows uniformly on the inclined plate in conjunction with the uniform feed rate of the woven stuff such that the woven stuff is dyed at a constant rate with constant and uniform coloration.

Additionally, since a plurality of guide blades 19 and 19' are secured in an equally spaced relationship to a traversing rod 18 mounted above the inclined plate 14 for reciprocal movement by air cylinder unit 17, the foam dye flowing on the inclined plate 14 can be guided in the right and left directions to form wavy or zig-zag patterns on the woven stuff.

According to the present invention, a plurality of foam distributors are disposed on the upper portion of the rectangular type frame member, and further, the inside construction or configuration of each distributor is divided into two, three or four chambers as required so as to accumulate foam dyes of different color therein, respectively. Moreover, the foam discharging tubes connected to the foam distributors can be arranged in any desired or arbitrary color order or arrangement in any required number on the lower portion of the rectangular type frame member. Accordingly, as another aspect of the present invention, the woven stuff can be dyed with various color foam dyes in a straight, wavy or zig-zag patterns using the simple construction and/or configuration in accordance with the present invention.

Furthermore, since the inclined plate and the cylindrical roll installed selectively, holdingly and rotatably to the lower portion thereof are provided beneath the foam discharging tubes, the foam dye takes a certain amount of time to flow down the inclined plate. Thus, as another aspect of the present invention, the different foam dyes and the foam's point of contact with the woven stuff are maintained at a constant level, and also the foam distribution state can be uniformly adjusted with the naked eye, all in order that the woven stuff can be dyed in the desired color designs and patterns, and simultaneously, the foam dyes flowing over the cylindrical roll installed holdingly and rotatably thereon is sufficiently permeated into the woven stuff.

A further aspect of the present invention exists in that since a traversing rod moved by an air cylinder unit is mounted above the inclined plate, and the guide blades secured to the traversing rod are in an equally spaced relationship corresponding to each of foam discharging tubes, the foam dye is guided side-to-side by the guide blades to form zig-zag patterns or to mix the different color foams in part so that the woven stuff is dyed with mixed color foam dyes in the desired designs or patterns.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A jet applicator for a multi-color type dyeing machine, said applicator comprising:

a frame member, a plurality of foam distributors disposed on the frame member, each foam distributor interiorly partitioned into at least two foam reservoir chambers, a plurality of foam supplying tubes connecting each foam reservoir chamber to a foam generator, a plurality of foam discharging tubes each having a foam supply end connected to a foam chamber and a foam discharge end secured to the frame member, an inclined plate removably provided beneath the foam discharge ends of the foam discharging tubes, a roller rotatably mounted adjacent to a lower portion of the inclined plate, a traversing rod movably provided above the inclined plate for reciprocal action along its axis approximately parallel to an axis of the roller, and a plurality of foam guide blades provided in an equally spaced relationship on the traversing rod.

2. A jet applicator as claimed in claim 1, wherein the frame member is mounted on a movable plate operatively associated with a screw member for reciprocal action along the plane of the frame member.

3. A jet applicator as claimed in claim 1, wherein the inclined plate is removed and the roller is provided beneath the foam discharge ends of the foam discharging tubes.

4. A jet applicator for a multi-color dyeing machine, said applicator comprising:

a plurality of foam distributors interiorly partitioned into a plurality of reservoir chambers and disposed on an upper portion of a rectangular type frame member reciprocated by a driving unit;

a plurality of foam discharging tubes connected to a bottom of each foam distributor and each end portion of the foam discharging tubes inserted into holes formed in the lower portion of the frame member;

an inclined plane provided immediately beneath each end portion of the foam discharging tubes;

a cylindrical roller mounted selectively, holdingly and rotatable to the lower portion of the inclined plane;

a traversing rod provided above the inclined plate for reciprocal action by an air cylinder unit along an axis of the traversing rod approximately parallel to an axis of the roller; and a plurality of guide blades secured in an equally spaced relationship on the traversing rod.

* * * * *